US010145593B2

(12) United States Patent
Lee et al.

(10) Patent No.: US 10,145,593 B2
(45) Date of Patent: Dec. 4, 2018

(54) AIR CONDITIONER WITH OIL SEPARATOR AND INJECTION CONTROL THEREOF

(71) Applicant: LG ELECTRONICS INC., Seoul (KR)

(72) Inventors: Seungjun Lee, Seoul (KR); Juhyeong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 206 days.

(21) Appl. No.: 15/012,927

(22) Filed: Feb. 2, 2016

(65) Prior Publication Data

US 2016/0231035 A1 Aug. 11, 2016

(30) Foreign Application Priority Data

Feb. 6, 2015 (KR) ..... 10-2015-0018773

(51) Int. Cl.

| | |
|---|---|
| ***F25B 43/02*** | (2006.01) |
| ***F25B 31/00*** | (2006.01) |
| ***F25B 1/04*** | (2006.01) |
| ***F25B 13/00*** | (2006.01) |
| ***F25B 49/02*** | (2006.01) |

(52) U.S. Cl.

CPC ..... *F25B 31/004* (2013.01); *F25B 1/04* (2013.01); *F25B 13/00* (2013.01); *F25B 43/02* (2013.01); *F25B 49/02* (2013.01); *F25B 2313/007* (2013.01); *F25B 2313/0253* (2013.01); *F25B 2400/07* (2013.01); *F25B 2400/23* (2013.01);

(Continued)

(58) Field of Classification Search

CPC .... F25B 31/004; F25B 43/02; F25B 2400/23; F25B 2500/16; F25B 2600/2509

See application file for complete search history.

(56) References Cited

U.S. PATENT DOCUMENTS

2011/0174005 A1* 7/2011 Takegami ..... F25B 1/10 62/228.1

FOREIGN PATENT DOCUMENTS

| | | |
|---|---|---|
| CN | 102099639 | 6/2011 |
| EP | 2 320 159 | 5/2011 |

(Continued)

OTHER PUBLICATIONS

"Scroll Compressors." EnggCyclopedia, Mar. 3, 2012, www.enggcyclopedia.com/2012/03/scroll-compressors/.*

(Continued)

*Primary Examiner* — Jonathan Bradford

(74) *Attorney, Agent, or Firm* — KED & Associates LLP

(57) ABSTRACT

An air conditioner is provided. The air conditioner may include a subcooling heat exchanger that evaporates a refrigerant, a compressor that compresses the refrigerant, an injection flow channel through which the evaporated refrigerant flows into the compressor, an injection valve that opens and closes the injection flow channel, an oil separator that separates oil from refrigerant discharged from the compressor, and an oil injection line, which communicates at a first end thereof with the oil separator and at a second end thereof with the injection flow channel so as to guide the oil separated by the oil separator toward the injection flow channel. The oil separated by the oil separator may selectively flow into the compressor through the oil injection line and the injection flow channel in accordance with a mode of operation of the air conditioner.

8 Claims, 11 Drawing Sheets

(52) U.S. Cl.
CPC ... *F25B 2500/16* (2013.01); *F25B 2600/2509* (2013.01)

(56) References Cited

FOREIGN PATENT DOCUMENTS

| | | |
|---|---|---|
| EP | 2 966 381 | 1/2016 |
| JP | 2004-176933 | 6/2004 |
| JP | 2006-242515 | 9/2006 |
| JP | 2007-178052 | 7/2007 |
| JP | 2010-032205 | 2/2010 |

OTHER PUBLICATIONS

European Search Report dated Jun. 15, 2016 issued in Application No. 16 15 2910.2.
Chinese Office Action dated Dec. 19, 2017 issued in Application No. 201610009544.3 (with English Translation).

* cited by examiner

AIR CONDITIONER WITH OIL SEPARATOR AND INJECTION CONTROL THEREOF

CROSS-REFERENCE TO RELATED APPLICATION

Pursuant to 35 U.S.C. § 119(a), this application claims priority to Korean Patent Application 10-2015-0018773, filed in Korea on Feb. 6, 2015, which is hereby incorporated by reference as if fully set forth herein.

BACKGROUND

1. Field

An air conditioner is disclosed herein.

2. Background

An air conditioner is an appliance that maintains air in a predetermined space in a condition most suitable for an intended application or objective. A typical air conditioner includes a compressor, a condenser, an expansion unit or device, and an evaporator, and is able to cool or heat a predetermined space by forward or reverse operation or circulation of a refrigerating cycle including compression, condensation, expansion, and evaporation of a refrigerant.

The predetermined space may refer to various spaces in which the air conditioner may be used or utilized. By way of example, when the air conditioner is installed or provided in a home or office, the predetermined space may refer to an indoor space or room in a house or building. When the air conditioner is installed or provided in a vehicle, the predetermined space may refer to a vehicle interior or passenger compartment which accommodates passengers.

When the air conditioner is operated in a cooling operation, an outdoor heat exchanger, which may be provided outside of an indoor space or room, may serve as a condenser, and an indoor heat exchanger, which may be provided inside of the indoor space or the room, may serve as an evaporator. In contrast, when the air conditioner is operated in a heating operation, the indoor heat exchanger may serve as a condenser, and the outdoor heat exchanger may serve as an evaporator.

FIG. 1 is a schematic diagram of a conventional air conditioner. Referring to FIG. 1, a conventional air conditioner 10 includes a compressor 13, an indoor heat exchanger 11, an expansion valve 15, and an outdoor heat exchanger 12. In this embodiment, symbol "I" designates the indoors, and symbol "O" designates the outdoors. The indoor heat exchanger 11 may be provided with an indoor fan 16, and the outdoor heat exchanger may be provided with an outdoor fan 17.

The air conditioner 10 may include a channel diverting valve 14, which is adapted to change a direction in which refrigerant circulates for conversion between a cooling cycle and a heating cycle. In this case, the channel diverting valve 14 may be a four-way valve.

The air conditioner 10 may further include an oil separator (not shown) to return oil, which is discharged together with refrigerant from the compressor 13, to the compressor 13, and an oil separator to prevent liquid-phase refrigerant from flowing into the compressor 13 by separating refrigerant which is not evaporated in the evaporator.

When the conventional air conditioner is operated in a cooling operation, the compressor 13 is operated at a low speed. When the compressor 13 is operated at a low speed, there is a problem whereby a compression efficiency of the compressor 13 is decreased.

BRIEF DESCRIPTION OF THE DRAWINGS

Embodiments will be described in detail with reference to the following drawings in which like reference numerals refer to like elements, and wherein.

DETAILED DESCRIPTION

Figure 1:
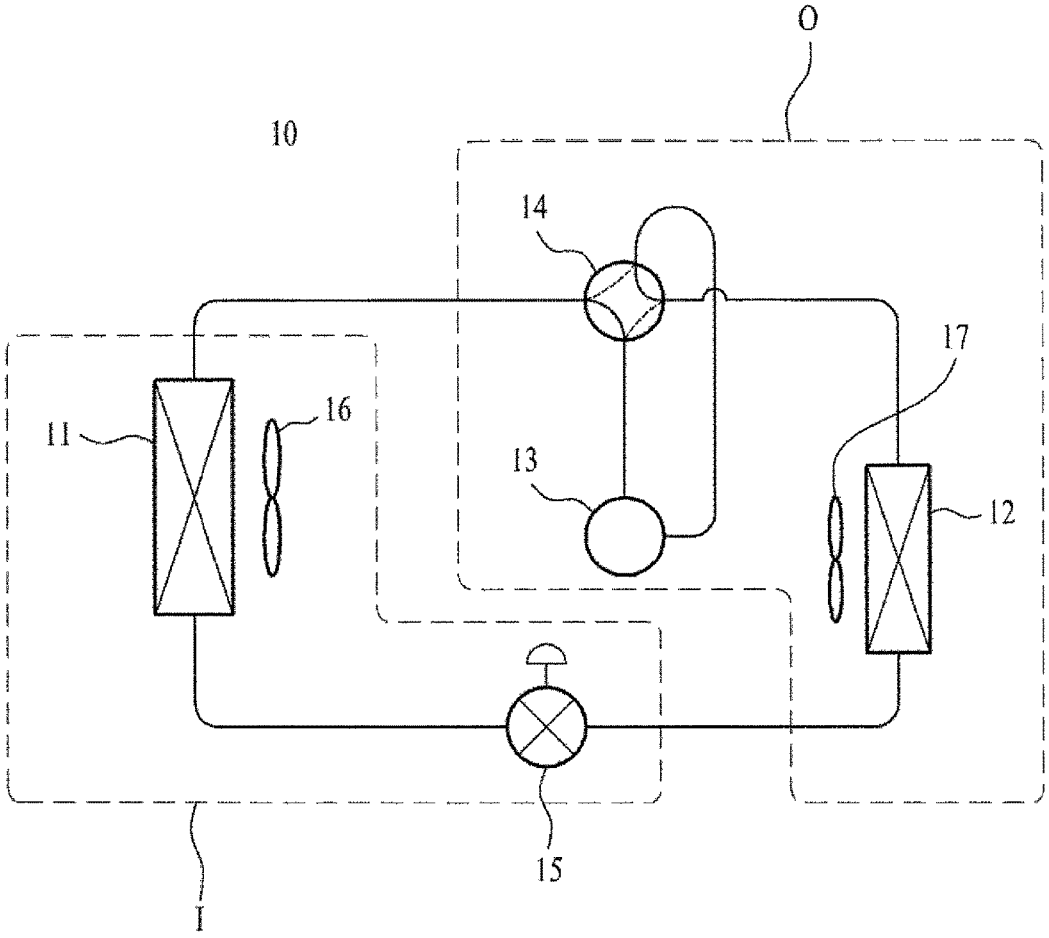
FIG. 1 RELATED ART
FIG. 1 is a schematic diagram of a conventional air conditioner.

Hereinafter, an air conditioner according to an embodiment will be described in detail with reference to the accompanying drawings. The accompanying drawings are provided only to illustrate an exemplary construction of embodiments, and a technical scope should not be construed as being limited by the drawings.

The same or similar elements have been assigned the same or like reference numerals, and redundant description thereof has been omitted. For clarity of description, shapes and sizes of components in the drawings may be exaggerated or scaled down.

Figure 2:
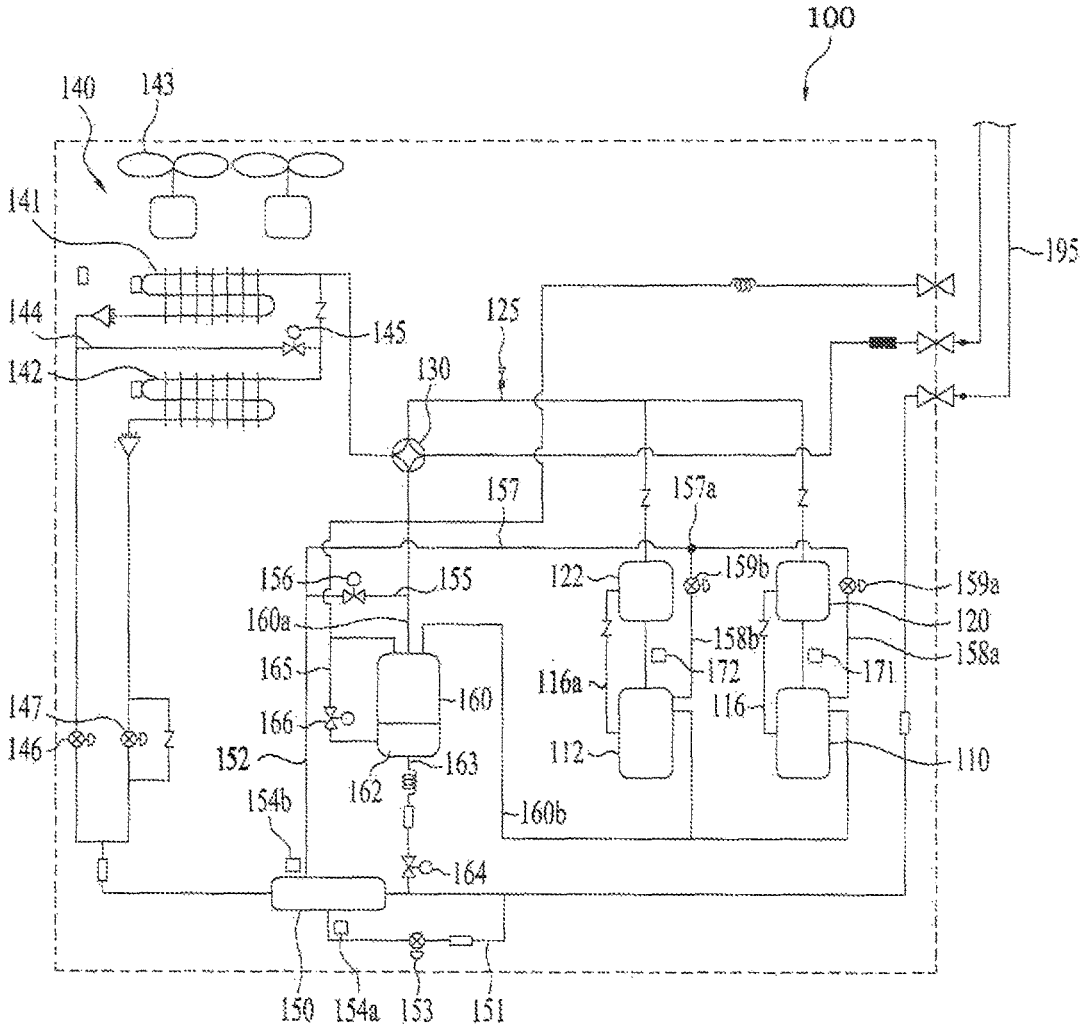
FIG. 2 is a schematic diagram of an outdoor device of an air conditioner according to an embodiment.

FIG. 2 is a schematic diagram of an outdoor unit or device of an air conditioner according to an embodiment. Referring to FIG. 2, an air conditioner according to an embodiment may include outdoor unit or device 100, which may be provided outside of a room or indoor space, and an indoor unit or device (not own), which may be inside of the room. The indoor device may include an indoor heat exchanger that exchanges heat with air inside of the room. As construction of the indoor device may be the same as or similar to a typical indoor unit or device, which is generally known or used, description thereof has been omitted.

The outdoor device 100 may include one or more compressors 110 and 112, and oil separators 120 and 122, which may be respectively disposed or provided at outlets of the compressors 110 and 112, respectively, so as to separate oil from the refrigerant discharged from the compressors 110 and 112. The compressors 110 and 112 may include a first compressor 110 and a second compressor 112. The first compressor 10 and the second compressor 112 may be connected in parallel to each other.

For example, the first compressor 110 may be a main compressor, and the second compressor 112 may be a sub compressor. In this case, when the first compressor 110 is first operated and a capacity of the first compressor 110 is insufficient, the second compressor 112 may be additionally operated, depending on a capacity of the system.

As another example, the first compressor 110 and the second compressor 112 may be operated concurrently. The first compressor 110 and the second compressor 112 may be different kinds, and may have different capacities.

The oil separators 120 and 122 may include a first oil separator 120, which may be disposed or provided at the outlet of the first compressor 110, and a second oil separator 112, which may be disposed or provided at the outlet of the second compressor 112.

The outdoor device 100 may include recovery flow channels 116 and 116*a*, which may be adapted to respectively recover oil from the oil separators 120 and 122 to the first and second compressors 110 and 112. In other words, the recovery flow channels 116 and 116*a* may include a first recovery flow channel 116, which may extend to the first compressor 110 from the first oil separator 120, and a second recovery flow channel 116*a*, which may extend to the second compressor 112 from the second oil separator 122.

The outdoor device 110 may include one or more temperature sensors 171 and 172, which may be respectively disposed or provided at the outlets of the first compressor 110 and the second compressor 112, respectively, so as to detect a temperature of refrigerant discharged from the first and second compressors 110 and 112, respectively. In other words, the temperature sensors 171 and 172 may be adapted to detect the temperatures of refrigerant discharged from the compressors 110 and 112, respectively. The temperature sensors 171 and 172 may include a first temperature sensor 171, which may be disposed or provided at the outlet of the first compressor 110, and a second temperature sensor 172, which may be disposed or provided at the outlet of the second compressor 112.

The outdoor device 100 may include a pressure sensor (high-pressure sensor) 125, which may be disposed or provided at the outlets of the oil separators 120 and 122 so as to detect a high pressure of the refrigerant discharged from the compressors 110 and 112. The outdoor device 100 may further include a flow diverter 130 that guides the refrigerant having passed through the pressure sensor 125 toward an outdoor heat exchanger 140 or the indoor device. The pressure sensor 125 may be adapted to detect the pressure, that is, high pressure of refrigerant discharged from the compressors 110 and 112.

When the air conditioner is operated in a cooling mode, refrigerant may be introduced into the outdoor heat exchanger 140 from the flow diverter 130. In contrast, when the air conditioner is operated in a heating mode, the refrigerant may be introduced into an indoor heat exchange (not shown) of the indoor device from the flow diverter 130.

The outdoor heat exchanger 140 may include a plurality of heat exchangers 141 and 142, and at least one outdoor fan 143. For example, the plurality of heat exchangers 141 and 142 may include a first heat exchanger 141 and a second heat exchanger 142, which may be connected in parallel to each other.

The outdoor heat exchanger 140 may include a variable flow channel 144 that guides a flow of refrigerant toward an inlet of the second heat exchanger 142 from an outlet of the first heat exchanger 141. The variable flow channel 144 may extend to a pipe connected to the inlet of the second heat exchanger 142 from a pipe connected to the outlet of the first heat exchanger 141.

The variable flow channel 144 may be provided with a variable valve 145 that selectively blocks a flow of the refrigerant. In response to an on/off action of the variable valve 145, the refrigerant having passed through the first heat exchanger 141 may be selectively introduced into the second heat exchanger 142.

More specifically, when the variable valve 145 is turned on or opened, the refrigerant having passed through the first heat exchanger 141 may be introduced into the second heat exchanger 142 through the variable flow channel 144. At this time, a first outdoor valve 146, which may be provided at the outlet of the first heat exchanger 141, may be closed.

A second outdoor valve 147 may be provided at an outlet of the second heat exchanger 142, and refrigerant, which has exchanged heat with the second heat exchanger 142, may thus be introduced into a subcooling, heat exchanger 150 through the second outdoor valve 147. When the variable valve 145 is turned off or closed, the refrigerant, which has passed through the first heat exchanger 141, may be introduced into the subcooling heat exchanger 150 through the first outdoor valve 146.

The first outdoor valve 146 and the second outdoor valve 147 may be disposed or provided in parallel so as to correspond to a disposition of the first and second heat exchangers 141 and 142. The subcooling heat exchanger 150 may be disposed or provided at an outlet of the outdoor heat exchanger 140.

When the air conditioner is operated in the cooling mode, the refrigerant, which has passed through the outdoor heat exchanger 140, may be introduced into the subcooling heat exchanger 150. The subcooling heat exchanger 150 may subcool the refrigerant, that is, liquid-phase refrigerant, which may be condensed in the outdoor heat exchanger 140, that is, the condenser. In other words, the outdoor heat exchanger 140 may serve as a condenser in the cooling mode. More specifically, the first heat exchanger 141 and the second heat exchanger 142, which may be provided in the outdoor heat exchanger 140, may serve as condensers.

The subcooling heat exchanger 150 may be considered to be an intermediate heat exchanger, at which a first refrigerant circulating in the refrigerant system, that is, a first refrigerant, which has passed through the outdoor heat exchanger 140, and refrigerant, which is branched from the first refrigerant, that is, a second refrigerant, exchange heat with each other, The first refrigerant may be a "main refrigerant", which may circulate in the system, and the second refrigerant may be a "branched refrigerant", which may be selectively injected into the compressors 110 and 112 or a gas-liquid separator 160.

The outdoor device 100 may include a subcooling flow channel 151, at which the second refrigerant may be branched. In this case, the subcooling flow channel 151 may be provided with a subcooling expansion device 153 that reduces the pressure of the second refrigerant.

The amount of refrigerant flowing through the subcooling flow channel 151 may vary in accordance with an extent to which the subcooling expansion device 153 is opened or closed. The subcooling expansion device 153 may be an electric expansion valve (EEV), for example.

The subcooling flow channel 151 may be provided with a plurality of temperature sensors 154*a* and 154*b*. The plurality of temperature sensors 154*a* and 154*b* may include a first subcooling sensor 154*a* that detects the temperature of refrigerant before the refrigerant flows into the subcooling heat exchanger 150, and a second subcooling sensor 154*b* that detects the temperature of the refrigerant which has passed through the subcooling heat exchanger 150. The first refrigerant may be subcooled, or over condensed, and the second refrigerant may be heated, or overheated, while the first refrigerant and the second refrigerant exchange heat with each other in the subcooling heat exchanger 150.

A "degree of superheating" of the second refrigerant may be determined based on respective temperature values detected by the first subcooling sensor 154*a* and the second subcooling sensor 154*b*. For example, the "degree of superheating" may be taken as a value obtained by subtracting the temperature value detected by the first subcooling sensor 154*a* from the temperature value detected by the second subcooling sensor 154*b*.

The degree of superheating may vary in accordance with the degree to which the subcooling expansion device 153 is opened or closed. For example, when an amount of refrigerant flowing through the subcooling flow channel 151 is decreased due to a decrease in an opening degree of the subcooling expansion device 153, the degree of superheating may be increased. In contrast, when the amount of refrigerant flowing through the subcooling flow channel 151 is increased due to an increase in the opening degree of the subcooling expansion device 153, the degree of superheating may be decreased. The second refrigerant, which has exchanged heat in the subcooling heat exchanger 150, may selectively flow into the gas-liquid separator 160 or the compressors 110 and 112.

The gas-liquid separator 160 may separate gas-phase refrigerant from the refrigerant before the refrigerant flows into the compressors 110 and 112. More specifically, the gas-liquid separator 160 may separate the refrigerant, that is, the second refrigerant, which has exchanged heat in the subcooling heat exchanger 150, into gas-phase refrigerant and liquid-phase refrigerant. A gas-phase portion of the refrigerant, which may flow into the gas-liquid separator 160 through a low-pressure flow channel 160*a*, may be guided toward the compressors 110 and 112 through an introduction flow channel 160*b*.

The refrigerant flowing through the introduction flow channel 160*b* may be branched into the first compressor 110 and the second compressor 112. The pressure (hereinafter, referred to as the "introduction pressure") of the refrigerant, which is introduced into the compressors 110 and 112, may be controlled so as to be maintained at a low pressure. More specifically, a discharge flow channel 152, through which refrigerant may be discharged from the subcooling heat exchanger 150, may be branched into a first guide flow channel 157 that guides the refrigerant toward the compressors 110 and 112, and a second guide flow channel 155 that guides the refrigerant toward the gas-liquid separator 160. The first guide flow channel 157 may extend to the compressors 110 and 112 from the discharge flow channel 152. In other words, the first guide flow channel 157 may connect the subcooling heat exchanger 150 to the compressors 110 and 112.

The first guide flow channel 157 may be provided with injection valves 159*a* and 159*b*, which may selectively block a flow of refrigerant. More specifically, the first guide flow channel 157 may include a first injection flow channel 158*a* that injects refrigerant into the first compressor 110, a second injection flow channel 158*b* that injects refrigerant into the second compressor 112, and a branch node 157*a*, at which the first guide flow channel 157 may be branched into the first injection flow channel 158*a* and the second injection flow channel 158*b*.

The first guide flow channel 157 may be provided with the injection valves 159*a* and 159*b*, which may be capable of controlling an amount of refrigerant injected into the compressors 110 and 112. The injection valves 159*a* and 159*b* may include a first injection valve 159*a*, provided on the first injection flow channel 158*a*, and a second injection valve 159*b*, provided on the second injection flow channel 158*b*.

The first and second injection valves 159*a* and 159*b* may each be an EEV. The amount of refrigerant injected into the compressors 110 and 112 may be controlled in accordance with an extent to which the first and second injection valves 158*a* and 158*b* are opened.

The second refrigerant, which has exchanged heat in the subcooling heat exchanger 150, may be injected into the compressors 110 and 112 through the first injection flow channel 158*a* and the second injection flow channel 158*b*. A pressure of the refrigerant injected into the compressors 110 and 112 may be an intermediate pressure, which may be higher than a pressure at which the refrigerant is introduced into the compressors 110 and 112 (hereinafter, referred to as an "introduction pressure"), but lower than a pressure at which the refrigerant is discharged from the compressors 110 and 112 (hereinafter, referred to as a "discharge pressure"). The discharge pressure may be the pressure detected by the pressure sensor (or high-pressure sensor) 125.

The second guide flow channel 155 may be connected to the low-pressure flow channel 160*a*. More specifically, the second guide flow channel 155 may connect the subcooling heat exchanger 150 to the gas-liquid separator 160.

The second guide flow channel 150 may be provided with a bypass valve 156 adapted to selectively block the flow of refrigerant, In other words, the second guide flow channel 155 may be provided with the bypass valve (or subcooling bypass valve) 156 that selectively blocks the flow of the refrigerant. An amount of the refrigerant that flows into the gas-liquid separator 160 may be controlled by varying an extent to which the bypass valve 156 is turned on or opened.

The refrigerant, that is, the second refrigerant, which has exchanged heat in the subcooling heat exchanger 150, may be selectively guided toward the gas-liquid separator 160 or the compressors 110 and 112, based on at least one of a temperature value detected by the temperature sensors 171 and 172 or a pressure value detected by the pressure sensor 125. Control of the refrigerant flow channel based on the temperature value and the pressure value will hereafter be described with reference to other drawings.

The outdoor device 100 may include a receiver 162 that stores at least a portion of the first refrigerant which has passed through the subcooling heat exchanger 150, and a receiver inlet flow channel 163, which may extend to the receiver 162 from an outlet of the subcooling heat exchanger 150 so as to guide the flow of refrigerant.

The receiver 162 may be coupled to the gas-liquid separator 160. For example, the receiver 162 and the gas-liquid separator 160 may be defined by partitioning an inside of a refrigerant storage tank. For example, the refrigerant storage tank may be provided at an upper part or portion thereof with the gas-liquid separator 160 and at a lower part or portion thereof with the receiver 162.

The receiver inlet flow channel 163 may be provided with a receiver inlet valve 164 that controls the flow of refrigerant. When the receiver inlet valve 164 is opened, at least a portion of the first refrigerant may flow into the receiver 162. The receiver inlet flow channel 163 may be provided with a decompression device that reduces the pressure of refrigerant flowing into the receiver 162.

The receiver 162 may be connected to a receiver outlet pipe 165. The receiver outlet pipe 165 may extend to the gas-liquid separator 160. At least a portion of the refrigerant stored in the receiver 162 may flow into the gas-liquid separator 160 through the receiver outlet pipe 165.

The receiver outlet pipe 165 may be provided with a receiver outlet valve 166 capable of controlling the amount of refrigerant discharged from the receiver 162. An amount of the refrigerant that flows into the gas-liquid separator 160 may be controlled by an extent to which the receiver outlet valve 166 is turned on or opened. The first refrigerant, which has passed through the subcooling heat exchanger 150, may flow into the indoor device (not shown) through a connecting pipe 195.

Hereinafter, a first flow state of refrigerant flowing in the outdoor device 100 is described with reference to FIG. 3.

A case in which the air conditioner is operated in a cooling mode is first described. However, even in a case in which the air conditioner is operated in a heating mode, a concept in which refrigerant having passed through the subcooling heat exchanger is selectively injected into the compressors or guided toward the gas-liquid separator is the same, with the exception that the refrigerant which has passed through the compressors is condensed in the indoor heat exchanger and evaporated in the outdoor heat exchanger. Accordingly, the technical idea will also be identically applied to the case in which the air conditioner is operated in the heating mode.

Figure 3:
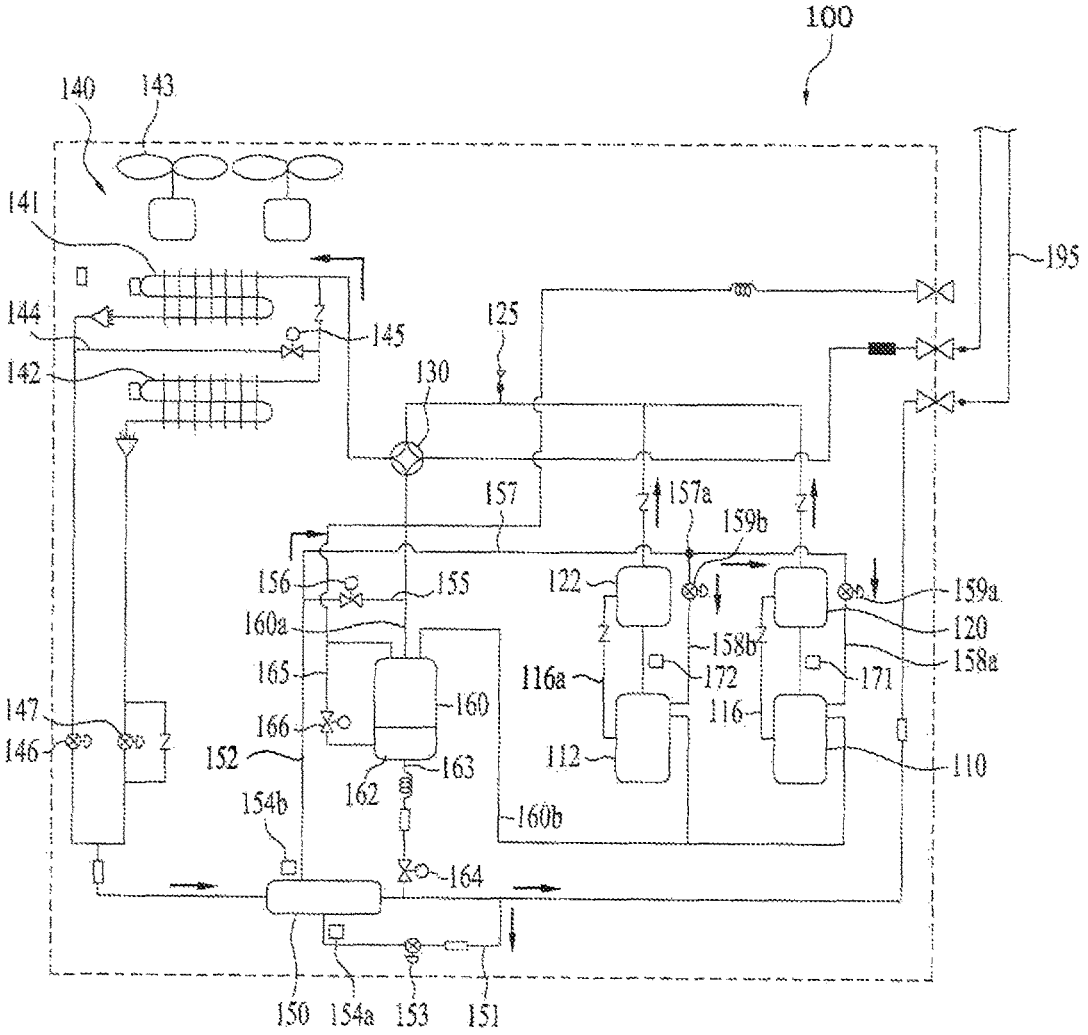
FIG. 3 is a schematic diagram illustrating a first flow state of refrigerant in the outdoor device shown in FIG. 2.

FIG. 3 is a schematic diagram illustrating a first flow state of refrigerant in the outdoor device shown in FIG. 2. More specifically, FIG. 3 illustrates a flow state of refrigerant, that is, a first flow state, when the temperature of the refrigerant, which may be detected at the outlets of the compressors 110 and 112 exceeds a predetermined temperature, and the pressure of the refrigerant, which may be detected at the outlets of the compressors 110 and 112, is lower than a predetermined pressure.

Referring to FIG. 3, the refrigerant, which is compressed by the compressors 110 and 112, may be supplied to the outdoor heat exchanger 140 through the flow diverter 130. In other words, the refrigerant compressed by the compressors 110 and 112 may be supplied to first and second heat exchangers 141 and 142 provided in the outdoor heat exchanger 140. The refrigerant, that is, the first refrigerant, which has exchanged heat in the outdoor heat exchanger 140, may flow into the subcooling heat exchanger 150.

The first refrigerant, which has passed through the subcooling heat exchanger 150, may flow toward the indoor device (not shown), a portion of the first refrigerant, that is, the second refrigerant, may be subjected to pressure reduction in the subcooling expansion device 153, provided on the subcooling flow channel 151, and may be heated or overheated and evaporated while passing through the subcooling heat exchanger 150.

The second refrigerant, which has flowed out of the subcooling heat exchanger 150, may be guided to or flow into the compressors 110 and 112 through the first guide flow channel 157 and the injection valves 159*a* and 159*b* provided on the first guide flow channel 157. More specifically, when the temperature of refrigerant, which may be detected at the outlets of the compressors 110 and 112, exceeds the predetermined temperature and the pressure of refrigerant, which may be detected at the outlets of the compressors 110 and 112, is lower than the predetermined pressure, the bypass valve 156 and the injection valves 159*a* and 159*b* may be controlled by a controller 200 (see FIG. 10), such that the bypass valve 156 may be closed and at least one of the injection valves 159*a*and 159*b* may be opened. As the amount of refrigerant passing through the compressors 110 and 112 is increased, an efficiency of the compressors 110 and 112 and a total efficiency of the system may be improved.

Hereinafter, a second flow state of refrigerant flowing in the outdoor device 100 is described with reference to FIG. 4.

Figure 4:
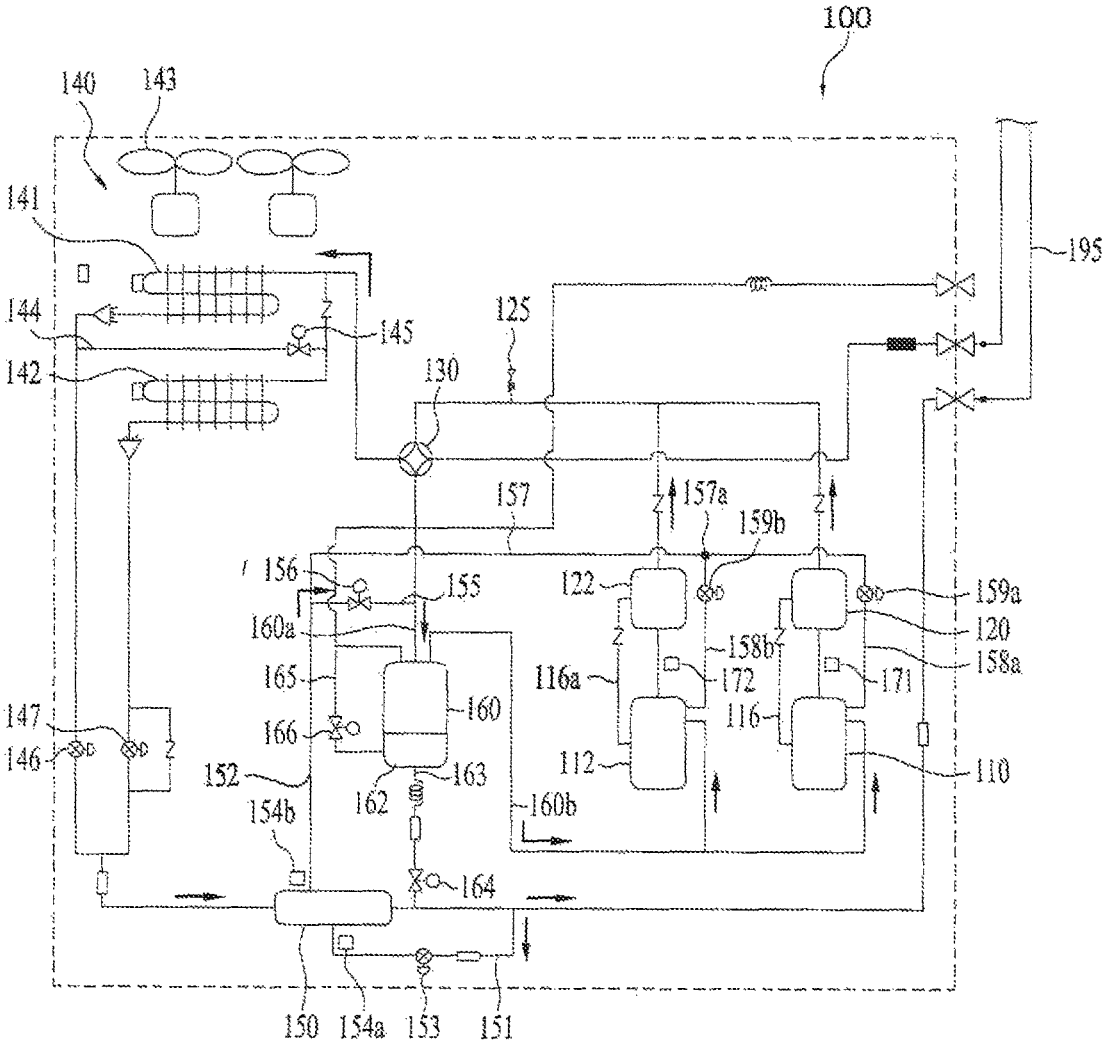
FIG. 4 is a schematic diagram illustrating a second flow state of refrigerant in the outdoor device shown in FIG. 2.

FIG. 4 is a schematic diagram illustrating a second flow state of refrigerant in the outdoor device shown in FIG. 2. More specifically, FIG. 4 illustrates a flow state of refrigerant when a temperature of refrigerant, which may be detected at the outlets of the compressors 110 and 112, is lower than the predetermined temperature or the pressure of refrigerant, which may be detected at the outlets of the compressors 110 and 112, is equal to or higher than the predetermined pressure.

Referring to FIG. 4, the refrigerant, which is compressed by the compressors 110 and 112, may be supplied to the outdoor heat exchanger 140 through the flow diverter 130. That is, the refrigerant compressed by the compressors 110 and 112 may be supplied to the first and second heat exchangers 141 and 142 provided in the outdoor heat exchanger 140.

The refrigerant, that is, the first refrigerant, which has exchanged heat in the outdoor heat exchanger 140, may flow into the subcooling heat exchanger 150. The first refrigerant, which has passed through the subcooling heat exchanger 150, may flow toward the indoor device (not shown), and a portion of the first refrigerant, that is, the second refrigerant, may be subjected to pressure reduction in the subcooling expansion device 153, provided on the subcooling flow channel 151, and heated or overheated and evaporated while passing through the subcooling heat exchanger 150.

The flow of refrigerant in this case may be the same as in the first flow state, which was described with reference to FIG. 3. However, the second refrigerant, which has flowed out of the subcooling heat exchanger 150, may be guided to or flow into the gas-liquid separator 160 through the bypass valve 156 provided on the second guide flow channel 155 and the second guide flow channel 155.

The gas-phase refrigerant, which is separated at the gas-liquid separator 160, may flow into the compressors 110 and 112 through the introduction flow channel 160*b*. More specifically, when the temperature of refrigerant, which may be detected at the outlets of the compressors 110 and 112, is lower than the predetermined temperature or the pressure of refrigerant, which may be detected at the outlets of the compressors 110 and 112, is equal to or higher than the predetermined pressure, the bypass valve 156 and the injection valves 159*a* and 159*b* may be controlled by the controller 200 (see FIG. 10), such that the bypass valve 156 may be opened and the injection valves 159*a* and 159*b* closed. As the gas-phase refrigerant is separated from the second refrigerant and flows into the compressors 110 and 112, the compressors 110 and 112 may be protected from damage and the efficiency of the compressors 110 and 112 and the overall system may be improved.

Figure 5:
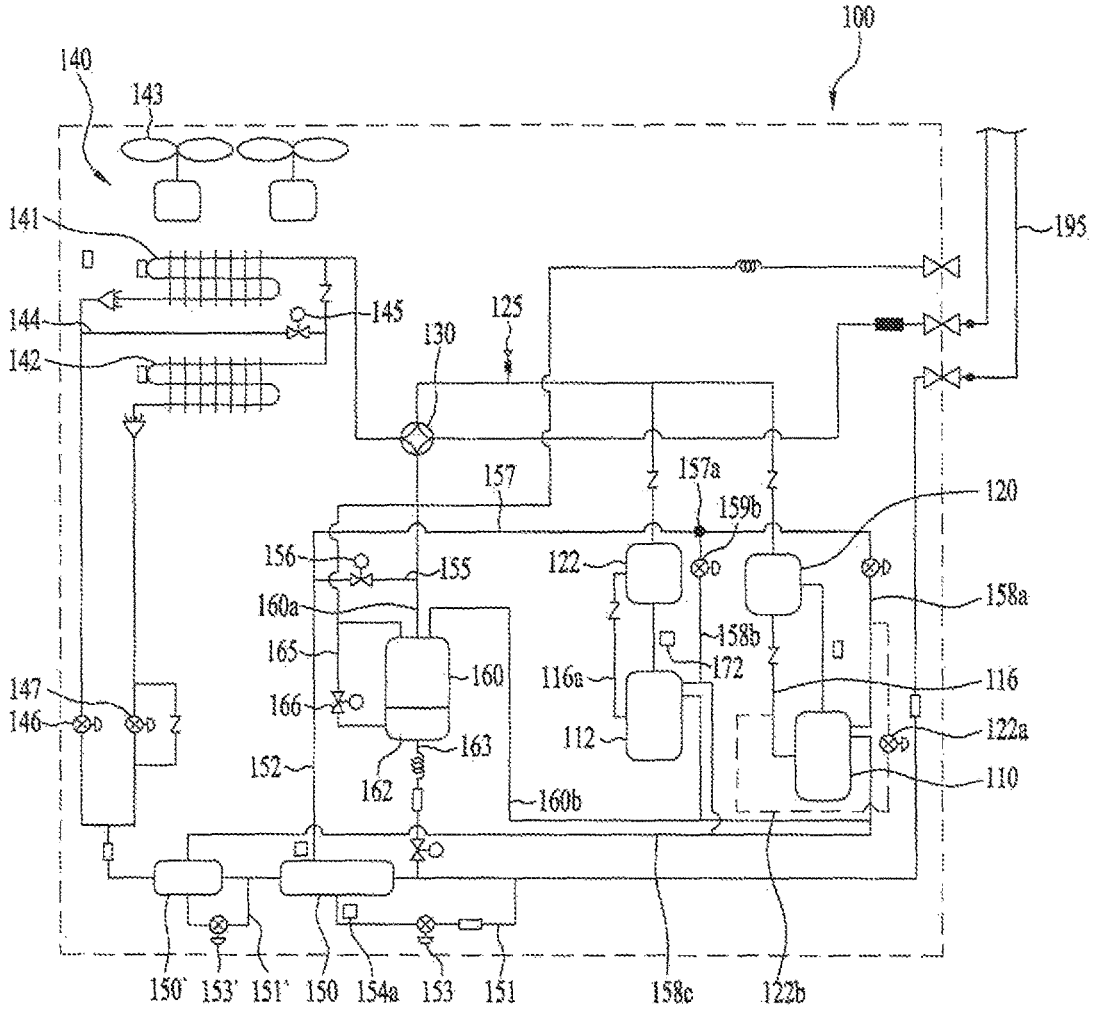
FIG. 5 is a schematic diagram illustrating the outdoor device shown in FIG. 2, to which an oil injection line is additionally added.

FIG. 5 is a schematic illustrating the outdoor device shown in FIG. 2, to which an oil injection line is additionally added. Referring to FIG. 5, the first recovery flow channel 116, which may connect the first oil separator 120 to the first compressor 110 so as to transfer the oil separated by the first oil separator 120, may be provided with an oil injection line 122*b* that transfers oil to the first injection flow channel 158*a*. Although FIG. 5 shows an example in which the oil injection line 122*b* is provided only on the first recovery flow channel 116, which may communicate with the first compressor 110, the oil injection line may also be provided on the second recovery flow channel 116*a*, which may communicate with the second compressor 112.

The oil injection line 122*b* may be branched from the first recovery flow channel 116 and may communicate with the first injection flow channel 158*a*, which may serve to allow gas-phase refrigerant to flow into the first compressor 110, such that oil separated by the first oil separator 120 may flow into the first compressor 110 through the first injection flow channel 158*a* and a second input end 340 (see FIG. 6), which will be described hereinafter, rather than flowing into the first compressor 110 through the first recovery flow channel 116.

However, as the first injection flow channel 158*a* serves as a flow channel through which gas-phase refrigerant flows into the first compressor 110 in the heating mode as described above, it is impossible to cause the oil, separated by the first oil separator 120, to flow into the first compressor 110 through the first injection flow channel 158*a* and the second input end 340 in the heating mode. Accordingly, the first injection flow channel 158*a* may be used as a flow channel, through which gas-phase refrigerant may flow into the first compressor 110 in the heating mode, and the first injection flow channel 158*a* may be used as a flow channel, through which the oil separated by the first oil separator 120 may flow into the first compressor 110 in the cooling mode.

Although the drawing illustrates an example in which the oil separated by the first oil separator 120 flows into the first compressor 110 through the oil injection line 122*b* and the first injection flow channel 158*a*, embodiments are not limited thereto. That is, the oil may flow directly into the first compressor 110 through the second input end 340 without passing through the first injection flow channel 158*a*. Further, the oil injection line 122*b* may further include an oil injection valve 122*a* that selectively blocks a flow of oil through the oil injection line 122*b*. More specifically, the oil injection valve 122*a* may be closed so as to prevent oil from flowing through the oil injection line 122*b* in the heating mode, and may be opened so as to allow oil to flow through the oil injection line 122*b* in the cooling mode.

Figure 6:
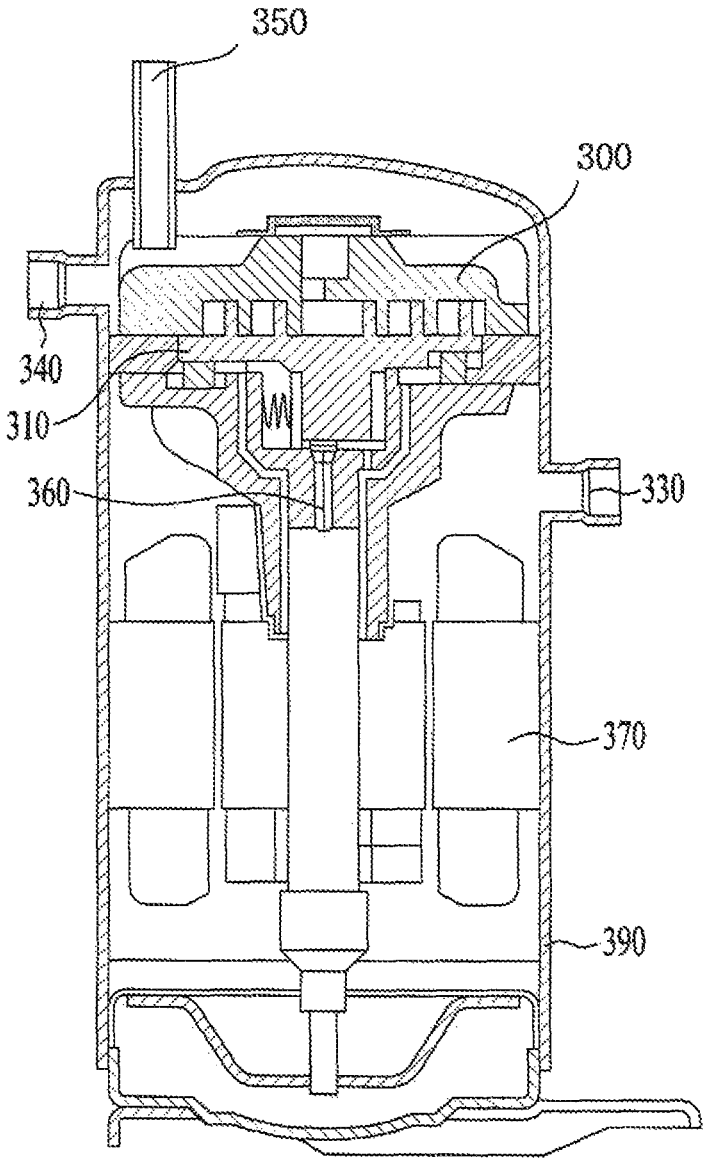
FIGS. 6 and 7 are cross-sectional views showing a compressor according to an embodiment.
Figure 7:
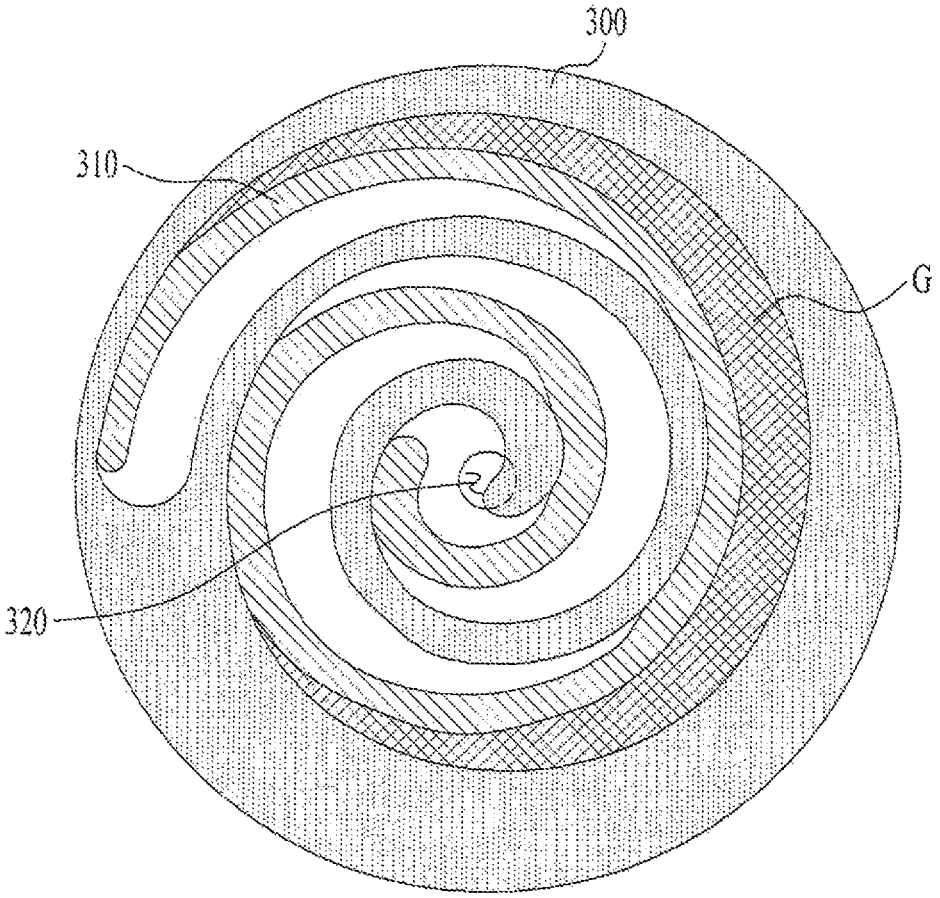

FIGS. 6 and 7 are cross-sectional views showing a compressor according to an embodiment. Referring to FIG. 6, the compressor according to this embodiment may include a compressor housing 390 that defines an outer appearance of the compressor, a motor 370, which may be provided in the compressor housing 390 so as to generate a rotational force, a shaft 360, which may be connected at a first end thereof to the motor 370 and at a second end thereof to an orbiting scroll 310 so as to transmit the rotational force of the motor 370 to the orbiting scroll 310, and a fixed scroll 300, which may be secured in a state of being spaced apart from the orbiting scroll 310 by a predetermined distance.

An upper portion of the compressor may include a first input end 330, at which a high pressure is created, a third input end 350, at which a low pressure may be created, and the second input end 340, at which an intermediate pressure (hereinafter, referred to as an "intermediate pressure"), which may be between the high pressure at the first input end 330 and the low pressure at the third input end 350, is created.

FIG. 7 is a plan view showing an upper surface of the scrolls 300, 310 of the compressor. Referring to FIG. 7, the orbiting scroll 310 may engage with the fixed scroll 300 such that the orbiting scroll 310 rotates in a state of being spaced apart from the fixed scroll 300 by a predetermined distance. A gas G may be positioned between the fixed scroll 300 and the orbiting scroll 310. As the orbiting scroll 310 rotates, a gap between the fixed scroll 300 and the orbiting scroll 310 may be reduced, and the gas G compressed under or to a high pressure. The gas G, which may be compressed under or to a the high pressure, may be discharged outside of the compressor through a discharge hole 320.

Figure 8:
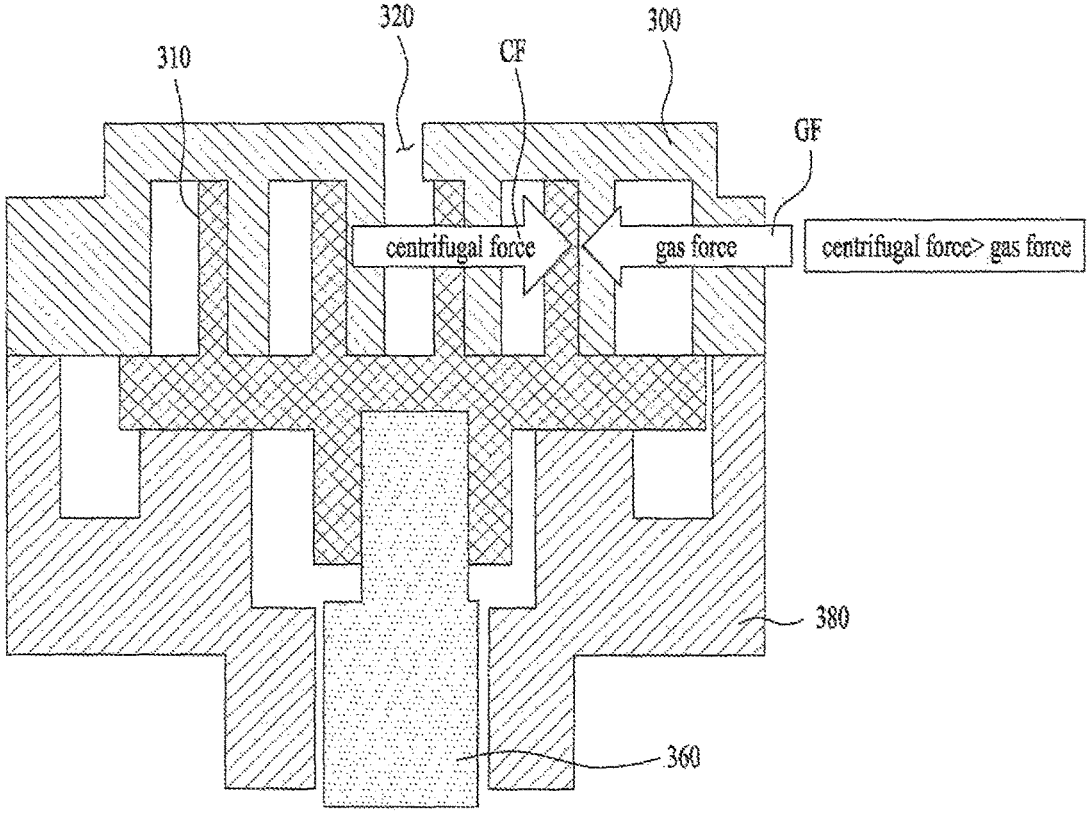
FIGS. 8 and 9 are cross-sectional views showing the compressor of FIG. 6-7 in a medium or high-speed operation and a low-speed operation, respectively.
Figure 9:
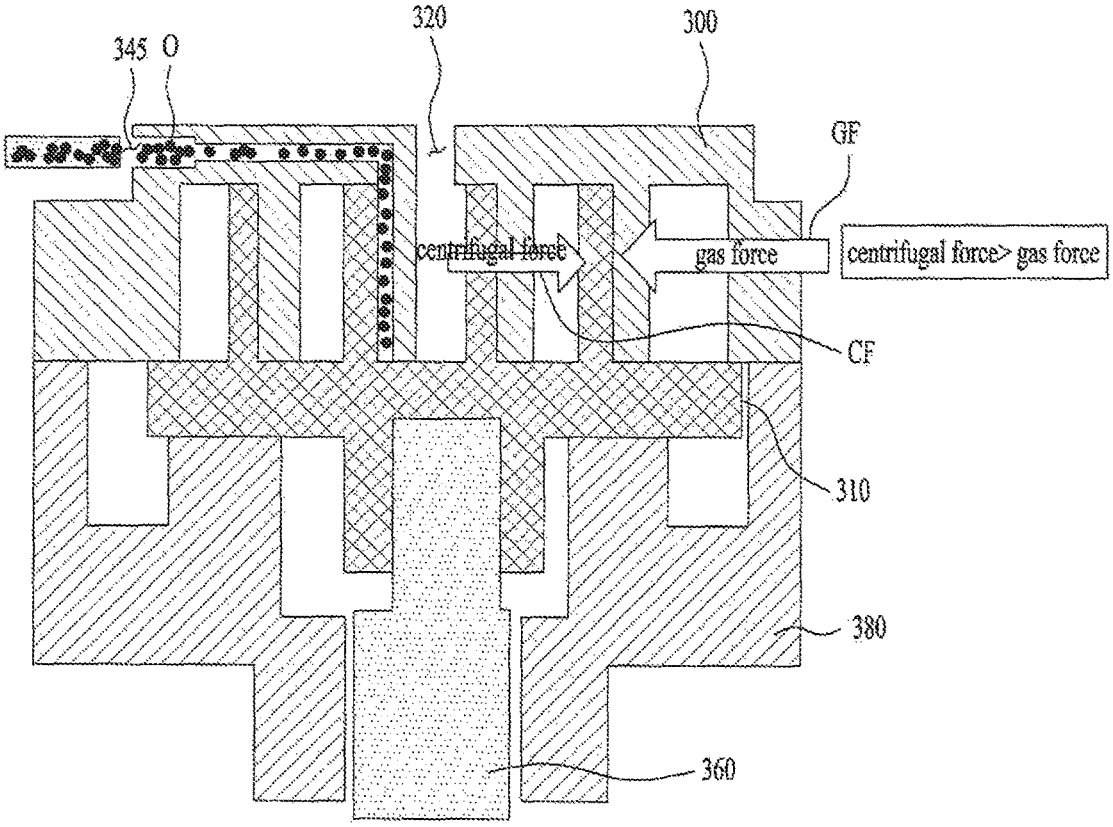
Figure 10:
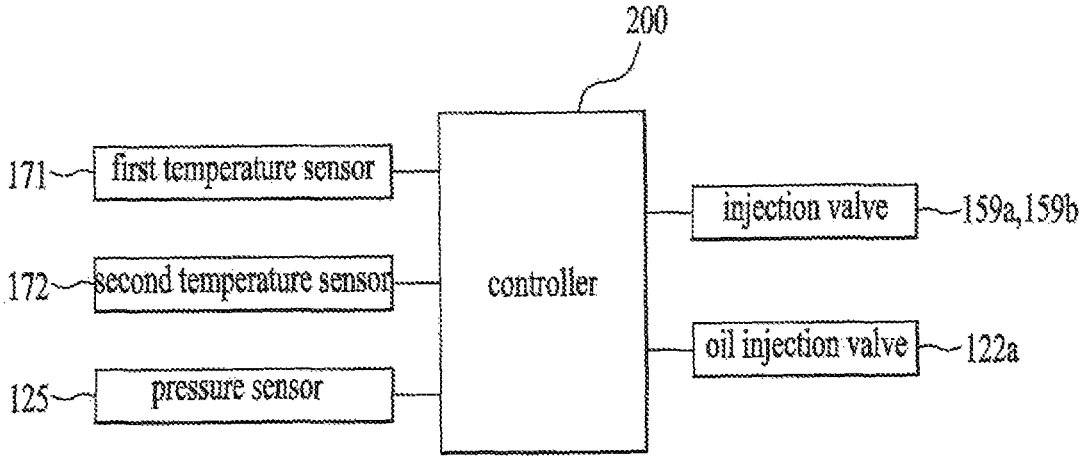
FIG. 10 is a block diagram of a controller of an air conditioner according to an embodiment.

FIG. 8 is a cross-sectional view showing scrolls of the compressor of FIGS. 6-7 in a medium or high-speed operation. FIG. 9 is a cross-sectional view showing scrolls of the compressor of FIGS. 6-7 in a low-speed operation. FIG. 10 is a block diagram of a controller of the air conditioner according to an embodiment.

Referring to FIG. 8, the shaft 360, which may serve to transmit the rotational force of the motor 370 to the orbiting scroll 310 as described above, may be provided in a scroll housing 380, and the orbiting scroll 310 may be rotatably mounted on an upper portion of the scroll housing 380. The fixed scroll 300 may engage with the orbiting scroll 310 in the state of being spaced apart from the orbiting scroll 310 by the predetermined distance.

The gas G may be positioned between the orbiting scroll 310 and the fixed scroll 300. As shown in the drawing, the gas G may generate a gas force GF toward a center of a circular motion of the orbiting scroll 310. As the orbiting scroll 310 is rotated by the shaft 360, the orbiting scroll 310 may generate a centrifugal force CF in an outward direction from the center of the circular motion. When the compressor is operated at a medium or high speed, the centrifugal force generated by the orbiting scroll 310 may be balanced with the gas force GF generated by the compressed gas G, and there may be almost no gap between the orbiting scroll 310 and the fixed scroll 300.

Referring to FIG. 9, which shows the scrolls 300, 310 of the compressor in low-speed operation, as a number of angular rotations of the shaft 360 is reduced during low-speed operation, the centrifugal force CF generated by the orbiting scroll 310 may be lower than the centrifugal force CF generated during medium or high-speed operation. Accordingly, there has been a problem in that a gap may be formed between the orbiting scroll 310 and the fixed scroll 300, but is not formed during medium or high-speed operation because the gas force GF is balanced with the centrifugal force CF.

The occurrence of the gap between the orbiting scroll 310 and the fixed scroll 300 causes a problem in that an amount of refrigerant leaking through the gap is increased, thus decreasing an overall efficiency of the compressor. Accordingly, the compressor according to an embodiment may include an oil injection hole 345, through which oil O may flow into the second input end 340. The oil separated by the first oil separator 120 may enter into the oil injection hole 345 through the oil injection line 122*b*, which may communicate with the first recovery flow channel 116. The oil O, which may be introduced into the oil injection hole 345, may flow between the fixed scroll 300 and the orbiting scroll 310, and fill the gap formed between the fixed scroll 300 and the orbiting scroll 310 during a low-speed operation, thereby preventing refrigerant from leaking through the gap and thus increasing the efficiency of the compressor. The oil injection valve 122*a* (see FIG. 10), which may be provided on the oil injection line 122*b* so as to open and close the oil injection line 122*b*, may be controlled to be opened so as to allow the oil O to flow into the compressor only during the cooling mode, at or during which the compressor is operated at a low speed.

Figure 11:
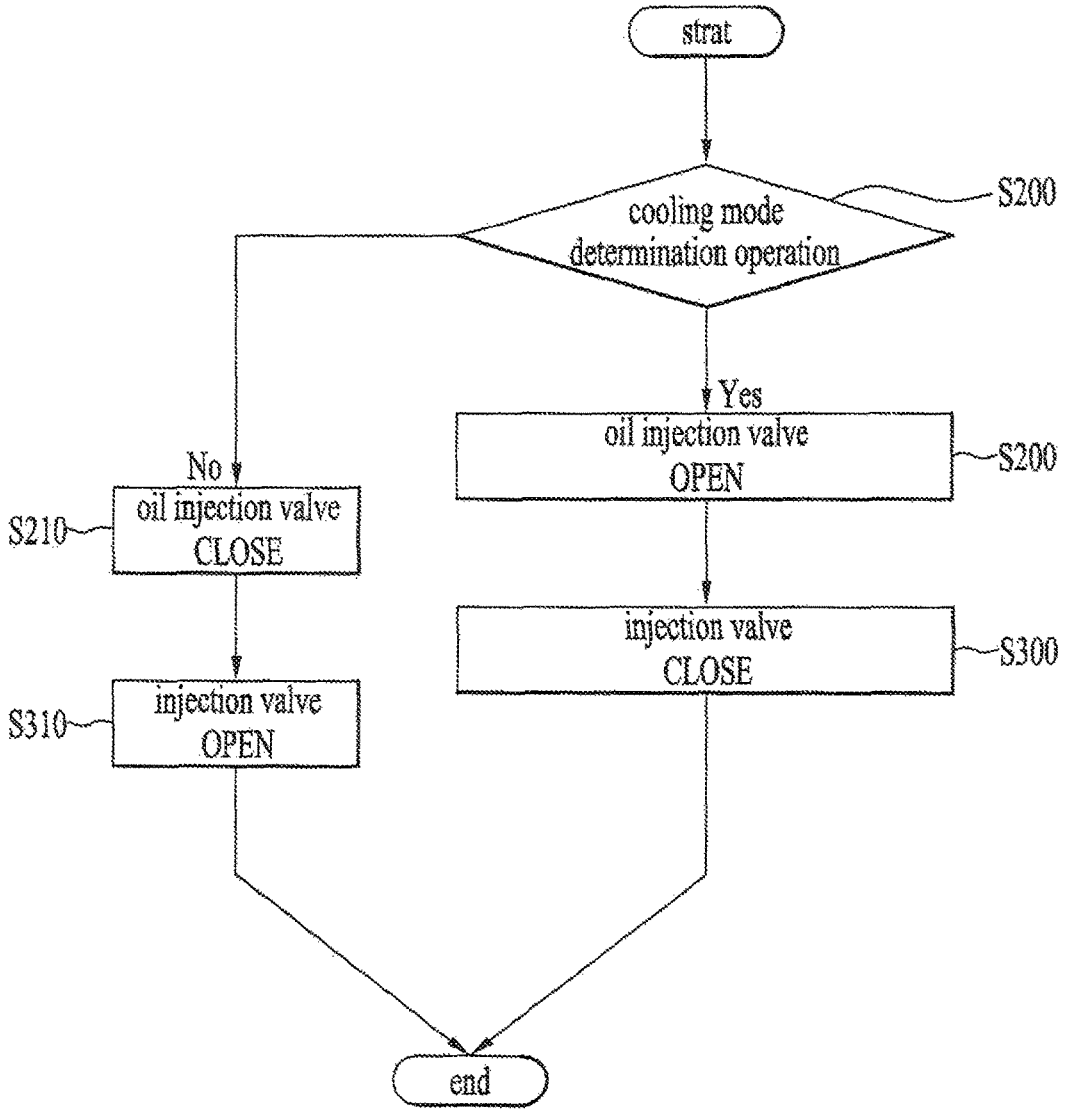
FIG. 11 is a flowchart showing a process of controlling an air conditioner according to an embodiment.

FIG. 11 is a flowchart showing a process of controlling an air conditioner according to an embodiment. Referring to FIG. 11, the process of controlling the air conditioner may include determining whether the air conditioner is to be used to executed a cooling mode or operation based on, a user input, for example (S100); opening the oil injection valve 122*a* (S200) if it is determined that she cooling mode is to be executed; and closing the injection valve after the oil injection valve 122*a* is opened (S300). If it is determined that a heating mode, rather than a cooling mode, is to be executed, the process may further include closing the oil injection valve 122*a* (S210), and opening the injection valve (S310) after the oil injection valve 122*a* is closed.

As is apparent from the above description, embodiments disclosed herein provide an air conditioner in which compression efficiency of a compressor is not decreased even during a cooling mode or operation. Further, embodiments disclosed herein provide an air conditioner in which the compression efficiency of the compressor is not decreased when the compressor is operated at a low speed.

Accordingly, embodiments disclosed herein are directed to an air conditioner that substantially obviates one or more problems due to limitations and disadvantages of the related art.

Embodiments disclosed herein further provide an air conditioner in which the compression efficiency of a compressor is not decreased even in a cooling operation. Embodiments disclosed herein provide an air conditioner in which the compression efficiency of the compressor is not decreased when the compressor is operated at a low speed.

Embodiments disclosed herein provide an air conditioner that may include a subcooling heat exchanger that evaporates a refrigerant, a compressor that compresses the refrigerant, an injection flow channel, through which the evaporated refrigerant may flow into the compressor, an injection valve that opens and closes the injection flow channel, an oil separator that separates oil from refrigerant discharged from the compressor, and an oil injection line, which may communicate at one or a first end thereof with the oil separator and at the other or a second end thereof with the injection flow channel so as to guide the oil separated by the oil separator toward the injection flow channel. The oil separated by the oil separator may selectively flow into the compressor through the oil injection line and the injection flow channel in accordance with a mode of operation of the air conditioner. The air conditioner may further include an oil injection valve that opens and closes the oil injection line.

The air conditioner may further include a controller that controls the injection valve and the oil injection valve in accordance with the mode or operation of the air conditioner. The controller may control the oil injection valve to be opened and the injection valve to be closed when the air conditioner is operated in a cooling mode or operation. The controller may control the oil injection valve to be closed and the injection valve to be opened when the air conditioner is operated in a heating mode or operation.

The compressor may include a compressor housing that defines an appearance of the compressor, a motor, which may be disposed or provided in the compressor housing so as to generate a rotational force, a shaft, which may be rotatably connected at one or a first end thereof to the motor, an orbiting scroll, which may be rotatably connected to the shaft and have at least one orbiting protrusion that protrudes toward one surface thereof, and a fixed scroll, which may be securely disposed or provided on the compressor housing and at least part or portion of which may contact the orbiting protrusion of the orbiting scroll in a surface-contact manner, and which may include a fixed protrusion that protrudes toward the orbiting protrusion.

The compressor may include an oil injection hole, which may be provided in one surface of the compressor and through which oil may flow toward the orbiting protrusion and the fixed protrusion. The oil injection hole may communicate with the injection flow channel. The oil ejection hole may communicate with the oil injection flow channel. The oil injection hole may include at least two oil injection holes, which communicate with the injection flow channel and the oil injection flow channel.

Any reference in this specification to "one embodiment," "an embodiment," "example embodiment" etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a subcooling heat exchanger that evaporates a refrigerant;

a compressor that compresses the refrigerant;

an injection flow channel, through which the evaporated refrigerant flows into the compressor;

an injection valve that opens and closes the injection flow channel;

an oil separator that separates oil from refrigerant discharged from the compressor;

a recovery flow channel configured to recover oil from the oil separator to the compressor;

an oil injection line, which communicates at a first end thereof with the oil separator and communicates at a second end thereof with the injection flow channel so as to guide the oil separated by the oil separator toward the injection flow channel, the oil injection line branched from the recovery flow channel;

an oil injection valve that opens and closes the oil injection line, wherein the oil separated by the oil separator selectively flows into the compressor through the oil injection line and the injection flow channel in accordance with a mode of operation of the air conditioner; and a controller that controls the injection valve and the oil injection valve in accordance with the mode of operation of the air conditioner, wherein the controller controls the injection valve and the oil injection valve such that the injection valve is closed and the oil injection valve is opened so as to allow the oil to flow into the compressor through the oil injection line and the injection flow channel during a cooling mode in which the compressor is operated at a low speed, and controls the oil injection valve to be closed and the injection valve to be opened when the air conditioner is operated in a heating mode, and wherein the injection flow channel is used as a flow channel through which gas-phase refrigerant flows into the compressor the heating mode and used as a flow channel through which the oil separated by the oil separator flows into the compressor in the cooling mode.

2. The air conditioner according to claim 1, wherein the compressor includes:

a compressor housing that defines an appearance of the compressor;

a motor, which is provided in the compressor housing so as to generate a rotational force;

a shaft, which is rotatably connected at one end thereof to the motor;

an orbiting scroll, which is rotatably connected to the shaft and has at least one orbiting protrusion that protrudes on one surface of the orbiting scroll thereof; and a fixed scroll, which is provided on the compressor housing and at least a portion of which contacts the orbiting protrusion of the orbiting scroll in a surface-contact manner, and which includes a fixed protrusion that protrudes toward the orbiting protrusion.

3. The air conditioner according to claim 2, wherein the at least one orbiting protrusion includes an orbiting wrap that extends from an orbiting plate of the orbiting scroll, and the fixed protrusion includes a fixed wrap that extends from a fixed plate of the fixed scroll, and wherein the orbiting wrap and the fixed wrap are overlapped to form a plurality of compression chambers when the orbiting wrap rotates with respect to the fixed wrap.

4. The air conditioner according to claim 2, wherein the compressor includes an oil injection hole, which is provided in one surface of the compressor and through which oil flows toward the orbiting protrusion and the fixed protrusion.

5. The air conditioner according to claim 4, wherein the oil injection hole communicates with the injection flow channel.

6. The air conditioner according to claim 4, wherein the oil injection hole communicates with the oil injection line.

7. The air conditioner according to claim 4, wherein the oil injection hole includes at least two oil injection holes, which communicate with the injection flow channel and the oil injection line, respectively.

8. An air conditioner, comprising:

a subcooling heat exchanger that evaporates a refrigerant;

a compressor that compresses the refrigerant;

an oil separator that separates oil from refrigerant discharged from the compressor;

an injection flow channel through which gas-phase refrigerant flows into the compressor in a heating mode and through which oil separated by the oil separator flows into the compressor in a cooling mode;

an injection valve that opens and closes the injection flow channel;

an oil injection line, which communicates at a first end thereof with the oil separator and communicates at a second end thereof with the injection flow channel so as to guide the oil separated by the oil separator toward the injection flow channel;

an oil injection valve that opens and closes the oil injection line, wherein the oil separated by the oil separator selectively flows into the compressor through the oil injection line and the injection flow channel in accordance with a mode of operation of the air conditioner; and a controller configured to close the injection valve and open the oil injection valve such that oil flows into the compressor through the oil injection line and the injection flow channel during the cooling mode in which the compressor is operated at a low speed, and configured to close the oil injection valve and open the injection valve when the air conditioner is operated in the heating mode.

* * * * *